United States Patent [19]

Swanson

[11] 4,250,815

[45] Feb. 17, 1981

[54] CANTILEVERED SHELF AND SUPPORTING MEANS

[75] Inventor: Richard H. Swanson, Manitowoc, Wis.

[73] Assignee: White Consolidated Industries, Inc., Cleveland, Ohio

[21] Appl. No.: 931,101

[22] Filed: Aug. 4, 1978

[51] Int. Cl.[3] ..... A47B 9/00

[52] U.S. Cl. ..... 108/108; 108/144; 211/182; 211/193; 248/243

[58] Field of Search ..... 108/108, 107, 106, 152, 108/144; 211/190, 193, 182, 208, 175, 153, 187, 149; 248/243, 73, 221.4, 222.2; 312/306, 281

[56] References Cited

U.S. PATENT DOCUMENTS

| | | | |
|---|---|---|---|
| 733,037 | 7/1903 | Heimann | 211/193 |
| 1,931,321 | 10/1933 | Keil | 248/243 |
| 2,894,643 | 7/1959 | Maslow | 211/182 X |
| 2,908,399 | 10/1959 | Streater | 108/106 X |
| 2,936,905 | 5/1960 | Welter | 211/153 |
| 2,971,805 | 2/1961 | Weiss | 248/243 |
| 3,208,406 | 9/1965 | Maslon | 211/182 X |
| 3,233,745 | 2/1966 | Hershberger | 211/149 X |
| 3,485,382 | 12/1969 | Larson | 108/107 X |
| 3,802,576 | 8/1957 | Kelling | 211/208 X |
| 3,915,097 | 10/1975 | Young, Jr. | 211/187 X |

*Primary Examiner*—James T. McCall

*Attorney, Agent, or Firm*—LeBlanc, Nolan, Shur & Nies

[57] ABSTRACT

An easily mountable and repositionable cantilevered shelf supported from the rear wall of a commercial refrigerator or freezer cabinet on two vertical support members secured inside on the rear wall. Each support member has longitudinal flanges projecting forward from an elongate vertical base fastened to the rear wall and formed with front channels facing toward the base part, opposed flanges of the channels of the two support members having notches along their length. Shelves are made from rod and wire construction with a solid cross bar across the rear upper shelf edge. The ends of the cross bar project laterally as short trunnions and hook into matched pairs of notches in the facing channel flanges of each support. Rearwardly projected lower rods incline downwardly and rearwardly on each side of the shelf and their ends abut against the mid-portions of the support channels so the shelf can be fulcrumed about the abutments to lock the trunnion ends of the cross bar into the associated, rearward directed, facing notches.

20 Claims, 9 Drawing Figures

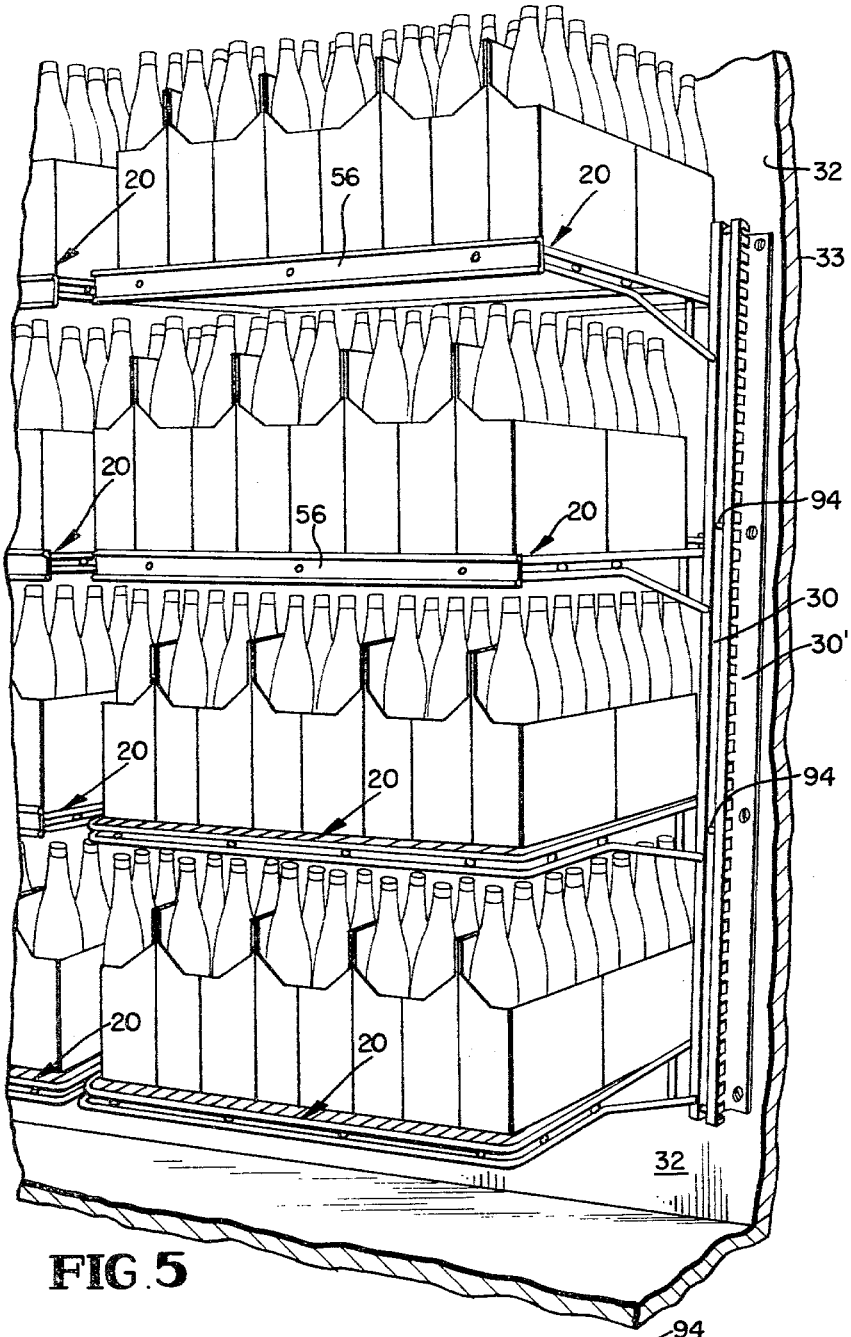
FIG. 5
FIG. 7
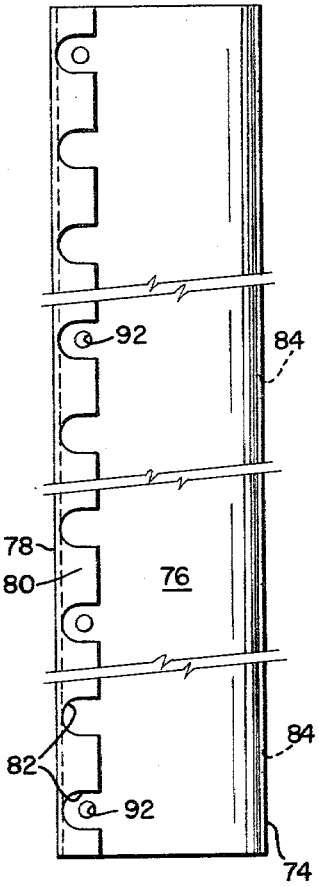
FIG. 8
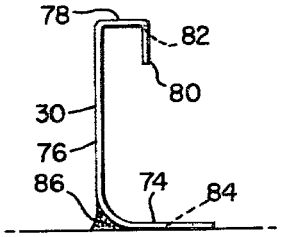
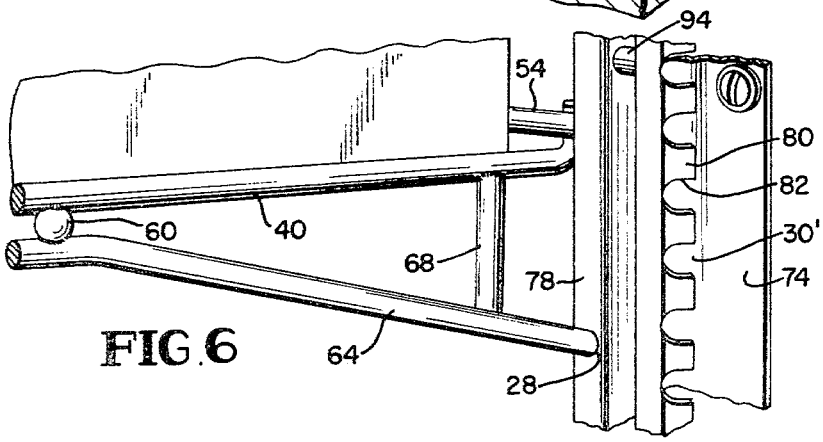
FIG. 6
FIG. 9
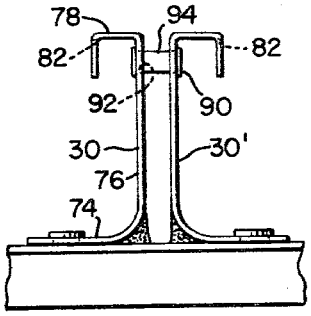

CANTILEVERED SHELF AND SUPPORTING MEANS

BACKGROUND OF THE INVENTION

This invention pertains to cantilevered shelves made from rods and wires, and was developed particularly for use in commercial refrigeration cabinets and the like. It is a shelf supported only at the rear end and is capable of supporting heavy loads yet provides for rapid repositioning on vertical support members.

Most prior art cantilevered shelf constructions incorporate two brackets, one secured on each side of the shelf and having at their rear ends attachment means enabling removable attachment to vertical support brackets. The rear attachment means on the shelf normally include upper and lower components, the upper one being hooked in some manner to a cooperative component on the vertical bracket and the lower portion of that rear shelf bracket abutting the vertical bracket. Basically such a principle is utilized in most cantilevered shelf constructions and can be found in the following U.S. Patents: U.S. Pat. No. 2,909,353 to J. McLean; U.S. Pat. No. 3,044,634 to M. A. Oztekin; U.S. Pat. No. 3,194,528 to R. G. Chesley; and U.S. Pat. No. 3,294,251 to C. B. Rollins, Jr.; U.S. Pat. No. 3,355,134 to R. J. Chesley; and U.S. Pat. No. 3,627,247 to George Krikorian. The foregoing patents all utilize wire shelves with some forms of flat plate attachment brackets which includes a hook inserted into a forwardly opening slot in a vertical support rail and a portion of the bracket plate below the hook portion cooperates with the vertical support rail in an abutment relationship which, in some cases, aids in locking and supporting the shelf. In addition a shelf construction is shown in U.S. Pat. No. 3,730,467 to L. G. Dutchburn utilizing an upper lateral rod portion bent up from and integral with a perimetral bent rod defining the shelf. That upper lateral rod portion enables the shelf to be hooked into the front side of support brackets over forwardly projecting complementary hook sections in a forwardly directed flange of the vertical support brackets. A second cross rod below the bent up rear lateral rod portion serves as the abutment part of Dutchburn's shelf.

SUMMARY OF THE INVENTION

This invention has been developed primarily for use in commercial refrigeration equipment and the cantilevered form of shelf has been selected because it eliminates supporting front posts, multiple shelf clips and customized widths of various dimension as are used in most conventional commercial refrigerator equipment. Support posts block product view, and such posts and interconnecting shelf clips result in higher cost and an inconvenience in repositioning such shelving.

The present invention provides a simplified and yet positive support means at the rear of the shelf which simplifies adjustment procedures and saves time when repositioning the shelves. It further provides a shelf unit for use in commercial refrigeration cabinet which has no posts or support brackets in the merchandising area or on the side walls of the cabinet and therefore permits products to be loaded, without structural interference, across the entire front of the merchandise area.

Accordingly, a primary object of the present invention resides in providing a per se novel rod and wire cantilevered shelf structure. In conjunction with this object the invention also provides a support permitting rapid, easy adjustment or repositioning of the shelf.

A further object in connection with the preceding object resides in providing such unit either as a vertical set of single or multiple shelves or as multiple sets of vertical shelves laterally arranged within a refrigerating cabinet.

A still further object resides in the provision of cantilevered shelf and vertical support brackets which are secured to vertical support structure in spaced apart relationship, the cantilevered shelves being constructed of rod members with wire grill shelving having rigid integral portions, which can be a heavy rear cross rod member, providing lateral outward trunnion-like projections at the rear upper edge of the shelf, the trunnion portions being hooked into notches formed along rearwardly directed flanges of specially shaped channel type vertical support members. Truss-like support rod constructions, inclined downwardly and laterally outward from the sides of the shelf unit, provides a level position abutment against the forward face of the vertical support members. Such support members can be doubled to provide for lateral sets of shelves.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which:

FIG. 5 is a partial view of a commercial refrigerator cabinet, partly broken away to illustrate a vertical group of shelves secured cantilevered fashion on vertical support members which in turn are secured to the back wall of the cabinet;

FIG. 6 is an enlarged detail view illustrating one of the side rear connection structures of the shelf which cooperates with a complementary portion of a double vertical support member;

FIG. 7 is a side view of one of the vertical support members;

FIG. 8 is a section through a single vertical support member; and

FIG. 9 is a cross-section through a double vertical support member.

GENERAL DESCRIPTION OF THE INVENTION

Figure 1:
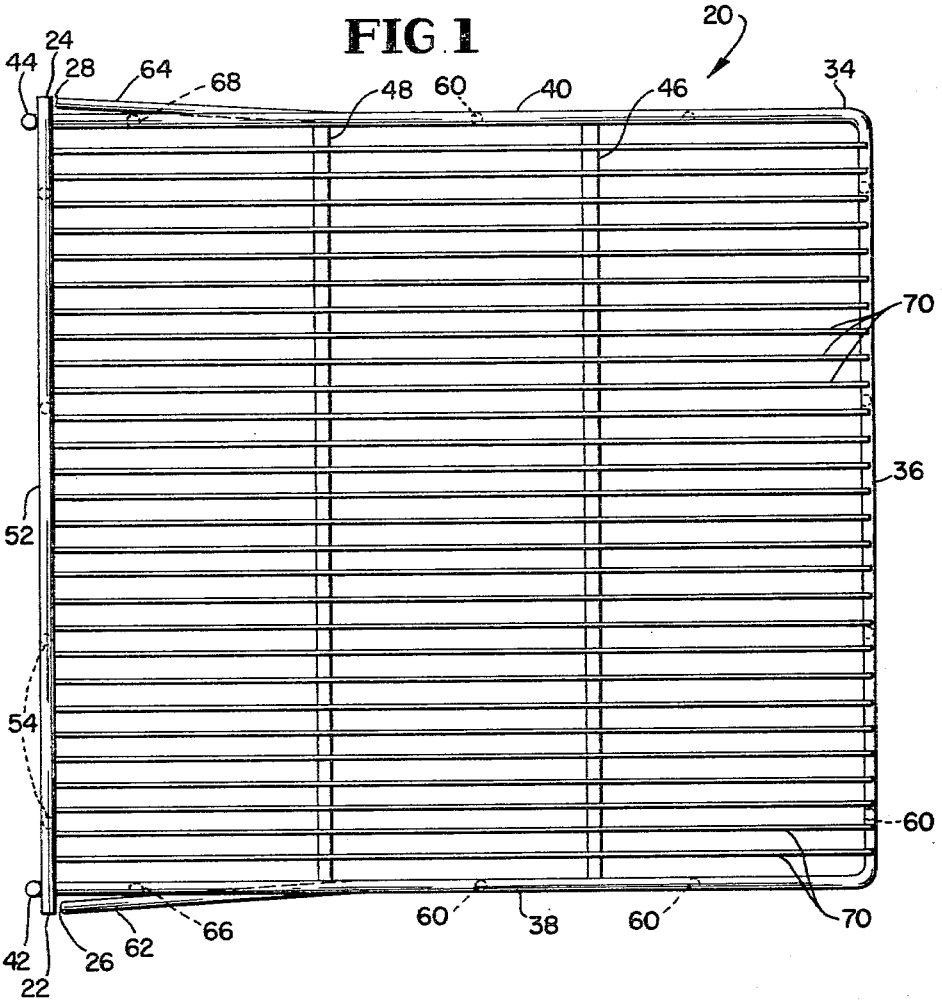
FIG. 1 is a plan view of a preferred construction of a cantilevered shelf, made in accord with the present invention.
Figure 3:
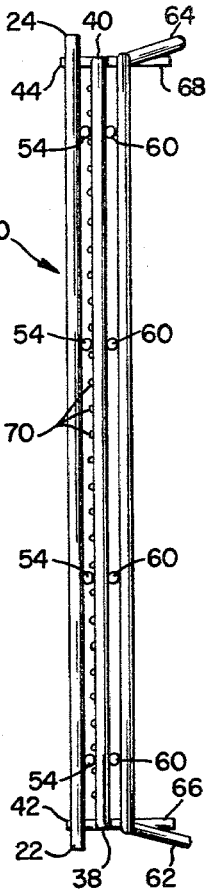
FIG. 3 is a front view of FIG. 1.
Figure 2:
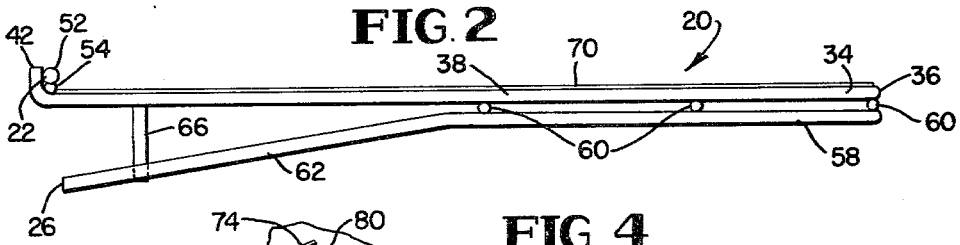
FIG. 2 is a side view of FIG. 1.

FIGS. 1–4 show a preferred specific construction of a shelf unit 20 including rear trunnion-like lateral projections 22 and 24 as well as abutment ends 26 and 28 situated under the trunnion portions, the trunnion portions and abutment portions on each side cooperating with vertical bracket members 30 which are secured to a vertical wall 32, e.g., the rear wall of a refrigerator cabinet 33 (see FIG. 5).

The basic frame of each shelf unit 20 includes a solid circular cross-section rod 34 bent in a U-shape, the center 36 of which defines the front edge of the shelf. The two side portions 38 and 40 extend at 90° angles from the front portion 36 to the rear end or edge of the shelf unit at which location each side rod portion terminates in an upwardly bent portion, 42 and 44 respectively. Three lateral cross rods 46, 48 and 50, extend between the side rod portions 38 and 40 and are integrally fastened thereto as by welding to provide a rigid load supporting frame structure. A similar size solid cross rod 52, disposed above the rear-most lateral cross rod 50, engages and is welded to the bent rear terminal end portions 42 and 44 of the side portions 38 and 40. The rear cross rod terminal end portions project laterally from the bent up rear end portions 42 and 44 and provide the trunnion-like portions 22 and 24 previously described. For additional strength the solid cross rod 52 is rigidly fastened to lateral cross rod 50 by a plurality of small ball shaped metal spacers 54 welded between and to each of the cross rods 50 and 52.

The shelf unit includes a second U-shaped heavy rod 58 located immediately below and spaced from the afore-described perimetral rod 34. The forward half of the lower U-shaped rod 58 matches the shape of the forward half of the perimetral rod 34 and is rigidly secured thereto by means of ball-shaped metal spacers 60 welded as described for ball-spacers 54 to provide an extremely rigid double rod shelf frame which also provides a pleasing front end appearance as well as a convenient mounting for conventional extruded product information attachment strips 56 (FIG. 5). Clearly shown in FIG. 2, the rear portions 62 and 64 of the side members of the U-shaped lower rod 58 have a downward inclination of approximately 15° as well as a slight outward inclination and terminate just forward of a vertical plane which is tangent to the front surface of the cross rod 52 and perpendicular to the plane of perimetral rod 34. The spacing of the terminal abutment ends from such a plane is theoretically equal to the thickness of the sheet metal from which the vertical support brackets are made.

Turning back to FIG. 1 the aforedescribed slight outward inclination of the lower rear rod portions 62 and 64 starts from approximately the mid-point of the rod side members, the resultant configuration placing the terminal ends of the two inclined portions 62 and 64 in lateral alignment and spaced below the trunnion-like end portions of the heavy cross rod 52. Small vertical lengths of rod 66 and 68 are welded to and depend from the underside of and spaced slightly forward from the rear ends of each of the upper two side rod portions 38 and 40. These two short rods 66 and 68 terminate adjacent to the inner side of the inclined lower rod abutment portions 62 and 64 respectively and are rigidly secured thereto by welding resulting in a truss beam construction. The afore-described structure provides a rigid and pleasing planar shelf unit 20. An upper support surface can be made of any suitable material, however, for refrigeration cabinet shelves it is constructed of a plurality of small wire rods 70 spot welded to the shelf frame rods 36, 46, 48 and 50 to constitute a support surface in the nature of an open grill to enable air circulation.

Shelf unit 20 is supported entirely at its rear end on two channel formed members 20 secured in vertical, laterally spaced apart relationship on a flat surface such as the rear wall 32 of a refrigerator compartment. Attachment of the vertical members 30 to the flat surfaces may be by any mechanical fastening means such as, thumb screw, cap screws or by use of a key slot fitted over rivet heads.

The details of construction of a vertical support are described with reference to FIGS. 7, 8 and 9 wherein is illustrated a vertical bracket 30 made from a single piece of sheet metal formed by bending into a special channel like configuration. The rear edge portion 74 is a mounting flange which extends the length of support bracket 30 and is bent at a 90° angle to the mid-portion 76 which projects forwardly from the mounting flange 74. In a preferred construction, the forwardly projected flange portion 76 extends approximately 55 mm from the mounting flange, at which location it is bent inwardly, parallel to and in the same direction as the flange 74, providing a narrow abutment 78, through a further 90° bend to terminate in an inwardly flange strip 80 which extends approximately 12 mm perpendicular to the mounting flange 74. Equally spaced apart along the inside flange 80 of the formed abutment channel are a plurality of notches or slots 82 located approximately 25 mm apart. The slots 82 are shaped to receive the trunnion projections 22 and 24 with a close free fit. A suitable number of mounting holes or slots 84 are provided in the rear flange 74 to enable securing by appropriate conventional fastening means to a rear wall of a cabinet or other structure. In the refrigerator cabinet construction the area adjacent to the curve between the base flange and the forwardly projecting flange can be faired and sealed with a sealing component such as white silicone 86 to prevent entrapment of moisture or other material.

Figure 4:
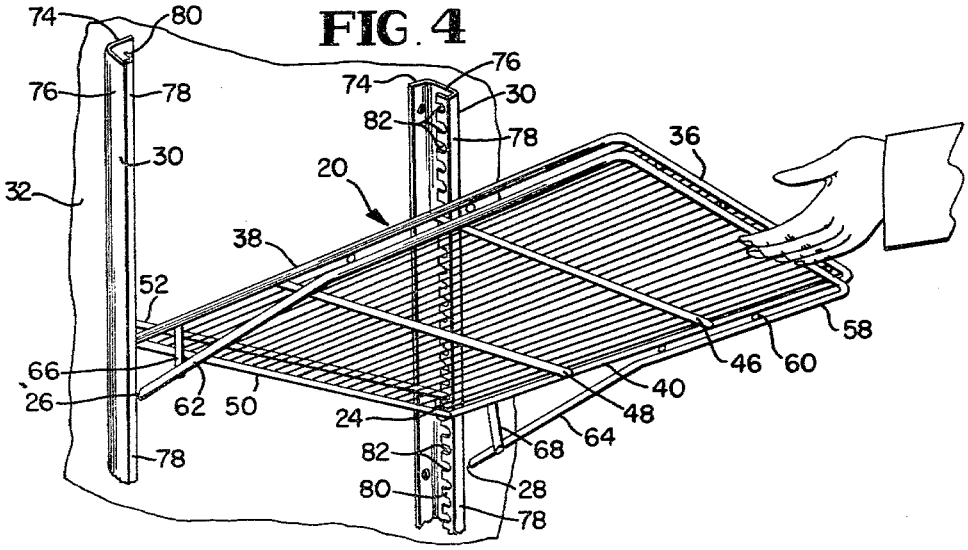
FIG. 4 illustrates how the shelf may be raised by its front end and shifted slightly to the rear to enable repositioning at another height where the rear trunnion projections fit into different pairs of slots or notches in a pair of the vertical support members.

Each vertical set of mounted shelves include two vertical support members 30 disposed in a right hand and left hand manner so that the slotted flanges 80 of the pair of support members face each other. As apparent from FIG. 4, a shelf unit 20 can be placed into position between the right and left support channels 30 by canting the shelf and placing the two trunnion-like end portions 22 and 24 of the cross bar 52 behind the slotted flanges 80. With the trunnion portions located at the rear of the slotted flanges 80 the shelf is recanted so the cross bar 52 is horizontal and the shelf 20 inclined inwardly, as depicted in FIG. 4, whereupon it can be raised or lowered to any desired location in increments of approximately one inch (25 mm). At a desired height position, the shelf can be moved forward so the trunnion portions 22 and 24 slip into a pair of associated slots 82 in the right and left support members 30. When engaged in selected slots 82, shelf 20 can be permitted to pivot downwardly until the abutment ends 26 and 28 of the abutment rods 62, 64 engage the channel abutment surfaces 78 of the associated vertical support members 30. So situated, the planar shelf will be horizontal and its trunnion portions 22 and 24 will be faced forward into their respective slots as a result of the shelf being fulcrumed about the two dependent abutments.

Viewing FIGS. 5 and 6, it will be seen that the vertical support structure illustrated on the right hand side of FIG. 5 is a double channel member, fabricated by joining two support members 30, see detail FIG. 9. The two support members 30 and 30′ can be rigidly joined by means such as rivets 90 fastened through suitably disposed holes 92 and spacer sleeves 94. Again, fillet spacing at the base of the double support channel can be filled with a sealing material such as white silicone. Using such dual channel vertical support members for the intermediate support members in a wide refrigerator cabinet 33 (FIG. 5) enables several sets of vertical groups of shelves 20 to be conveniently assembled in close relationship without waste of cabinet space.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A cantilevered shelf and support construction comprising: at least one planar shelf means, with means rigid with the upper rear of said shelf means providing a short lateral trunnion like projection extending from adjacent each top rear corner of said shelf means and rearwardly disposed abutment means depending from the sides of said planar shelf means to a location below said projections and in front of a plane through the forward surface of said projections and perpendicular to the planar shelf means; and at least a pair of parallel spaced apart vertically disposed elongate shelf support brackets secured to a vertical surface, each bracket having a front laterally projected portion facing and spaced forward from the vertical surface, the central portion of said lateral portion providing an elongate vertical abutment surface for an associated one of said shelf abutment means, the lateral portions of said pair of brackets facing each other and having their under portions provided with a plurality of matched, spaced apart, open ended slots opening toward and spaced from the vertical surface a distance greater than the cross-section dimension, in a fore and aft direction, of said projections; said projections being received in a matched pair of said slots with said abutment means engaging associated said abutment surfaces, the projections being maintained in the slots by the downward force of said shelf means fulcrumed on said abutment means; whereby said shelf means can be repositioned by upward tilting and rearward shifting of said shelf means to remove the projections from engagement with associated said slots and permitting vertical repositioning of the shelf means to a different location.

2. The construction as defined in claim 1, wherein each said bracket is made from sheet metal bent to form a flat mounting flange with a forwardly projecting support web which continues with additional bends to provide said lateral projected portion.

3. The construction as defined in claim 2, wherein said shelf means includes a U-shaped rod, said trunnion-like projections are end portions of a cross bar rigidly secured to the ends of said U-shaped rod with said end portions projected beyond the side legs of said U-shaped rod, and each said abutment means is a trussed beam construction made from rods secured to the legs of said U-shaped rod.

4. The construction as defined in claim 1, wherein said shelf means is made from a U-shaped rod, said trunnion-like projections are end portions of a cross bar rigidly secured to the ends of said U-shaped rod with said end portions projected beyond the side legs of said U-shaped rod.

5. The construction as defined in claim 4, wherein a plurality of spaced apart cross rods are rigidly secured between the legs of said U-shaped rod and wherein a grid constituting a plurality of wire rods secured to the top of said shelf rods provides a support surface for said shelf means.

6. The construction as defined in claim 4, wherein a second U-shaped rod is spaced below said first named U-shaped rod and means rigidly secure the front and side leg portions of both U-shaped rods to each other, the rear portions of said second U-shaped rod being bent at a downward and slightly outward inclination and terminating in abutment ends and comprising said abutment means.

7. The construction as defined in claim 6, wherein short upright rods are rigidly secured between said rear portions and said legs of the first named U-shaped rod to provide a truss beam construction of said abutment means.

8. The construction as defined in claim 7, wherein the terminal ends of said first named upper U-shaped rods are bent to form short upright lugs and said cross bar rests against and is rigidly secured to said upright lugs.

9. The construction as defined in claim 8, wherein at least one cross rod means rigidly joins the end portions of the side legs of said first named U-shaped member and means rigidly join said cross bar and said cross rod means.

10. The construction as defined in claim 1, wherein said shelf means comprises a rectangular arrangement of rod means with front, back and side rod portions, said trunnion-like projections are end portions of a cross bar rigidly secured to the rear part of said side rod portion and to said back rod portion with the said end portions of the cross bar projected beyond the side rod portions, and each said abutment means comprises a trussed beam construction made from rods including part of said side rod portions.

11. The construction as defined in claim 1, wherein said vertical surface is the rear wall of a commercial refrigeration equipment cabinet, and a plurality of said shelves are included on at least one pair of said shelf support brackets.

12. A construction as defined in claim 11, wherein at least two side-by-side sets of vertical shelves are provided and each set of shelves include a pair of said shelf support brackets, the intermediate two shelf support brackets are constructed of two of said shelf support brackets disposed in complementary side-by-side disposition and means, rigidly join said two side-by-side support brackets.

13. A construction as defined in claim 1, wherein said abutment means depending from the rear side edges of said planar shelf means have terminal abutment portions disposed laterally outward from the sides of said shelf means; each laterally projected portion of each bracket comprising a front channel shaped portion, the channel facing and spaced forward from the vertical surface, the central portion of said channel providing said elongate vertical abutment surface for an associated one of said shelf abutment means and the channel flange portions of said pair of brackets which face each other being provided with said plurality of matched, spaced apart, open ended slots.

14. The construction as defined in claim 13, wherein each said bracket is made from sheet metal bent to form a flat mounting flange with a forwardly projecting support web which continues with additional bends to provide said channel shaped portion.

15. The construction as defined in claim 14, wherein said shelf means includes a U-shaped rod, said trunnion-like projections are end portions of a cross bar rigidly secured to the ends of said U-shaped rod with said end portions projected beyond the side legs of said U-shaped rod, and each said abutment means is trussed beam construction made from rods secured to the legs of said U-shaped rod and the ends of rods constitute said terminal abutment portions.

16. Shelf support bracket construction, for use with a planar shelf having a short lateral trunnion-like projections extending from adjacent each top rear corner of the shelf and abutments depending from the rear side edges of the shelf means and disposed laterally outward from the sides of the shelf to a location below the projections, comprising: an elongate shelf support bracket with a flat base flange, at least two of which are used to support a shelf and are adapted to be secured in parallel spaced apart vertical disposition to a vertical surface, each bracket having a front laterally projected portion facing and spaced forward from the vertical surface, the central portion of said lateral portion providing an elongate vertical abutment surface for an associated one of the shelf abutment means, the lateral portions of said bracket having its under portion provided with a plurality of spaced apart, open ended slots opening toward and spaced from said flat flange a distance greater than the cross-section dimension, in a fore and aft direction, of the shelf projection.

17. The construction as defined in claim 16, wherein each said bracket is made from sheet metal bent to form a flat mounting flange with a forwardly projecting support web which continues with additional bends to provide said lateral projected portion.

18. The construction as defined in claim 16, wherein a combination two shelf support bracket is constructed of two of said shelf support brackets disposed in complementary side-by-side disposition and means, rigidly join said two side-by-side support brackets.

19. The construction as defined in claim 18, wherein each said bracket is made from sheet metal bent to form a flat mounting flange with a forwardly projecting support web which continues with additional bends to provide said lateral projected portion, and said support webs are adjacent and parallel to one another and the means which rigidly secure said brackets are secured to said support webs.

20. The construction as defined in claim 4, wherein the terminal ends of said U-shaped rod are bent to form short upright lugs and said cross bar rests against the front of said upright lugs.

* * * * *

UNITED STATES PATENT AND TRADEMARK OFFICE

CERTIFICATE OF CORRECTION

PATENT NO. : 4,250,815

DATED : February 17, 1981

INVENTOR(S) : Richard H. Swanson, Manitowoc, Wis.

It is certified that error appears in the above-identified patent and that said Letters Patent are hereby corrected as shown below:

In References Cited:
Change "3,208,406 9/1965 Maslon 211/182X" to --3,208,406 9/1965 Maslow 211/182X--.

In the Claims:

Col. 6, line 17, change "rods" to --rod--.

Signed and Sealed this

*Fifteenth* Day of *September 1981*

[SEAL]

*Attest:*

GERALD J. MOSSINGHOFF

*Attesting Officer*

*Commissioner of Patents and Trademarks*